US012753477B2

(12) United States Patent
Hamamoto et al.

(10) Patent No.: US 12,753,477 B2
(45) Date of Patent: Oct. 6, 2026

(54) HIGH-STRENGTH ALLOYED HOT-DIP GALVANIZED STEEL SHEET AND MANUFACTURING METHOD THEREFOR

(71) Applicant: Kabushiki Kaisha Kobe Seiko Sho (Kobe Steel, Ltd.), Kobe (JP)

(72) Inventors: Sae Hamamoto, Kakogawa (JP); Haruka Araki, Kakogawa (JP); Michitaka Tsunezawa, Kakogawa (JP)

(73) Assignee: Kobe Steel, Ltd., Kobe (JP)

( * ) Notice: Subject to any disclaimer, the term of this patent is extended or adjusted under 35 U.S.C. 154(b) by 39 days.

(21) Appl. No.: 18/559,094

(22) PCT Filed: May 16, 2022

(86) PCT No.: PCT/JP2022/020394
§ 371 (c)(1),
(2) Date: Nov. 6, 2023

(87) PCT Pub. No.: WO2022/249919
PCT Pub. Date: Dec. 1, 2022

(65) Prior Publication Data

US 2024/0240298 A1 Jul. 18, 2024

(30) Foreign Application Priority Data

May 26, 2021 (JP) ..... 2021-088740
Sep. 1, 2021 (JP) ..... 2021-142112

(51) Int. Cl.
*C23C 2/06* (2006.01)
*C21D 8/0221* (2026.01)
(Continued)

(52) U.S. Cl.
CPC ..... *C23C 2/06* (2013.01); *C21D 8/0226* (2013.01); *C21D 8/0236* (2013.01);
(Continued)

(58) Field of Classification Search
CPC ..... C23C 2/06; C23C 2/40; B32B 15/013; C22C 38/001; C22C 38/002;
(Continued)

(56) References Cited

U.S. PATENT DOCUMENTS

2011/0048589 A1 3/2011 Matsuda et al.
2019/0321907 A1 10/2019 Lei et al.
(Continued)

FOREIGN PATENT DOCUMENTS

EP 1146132 B1 10/2001
EP 3279363 B1 2/2018
(Continued)

OTHER PUBLICATIONS

Maruyama et al., JP2015175050A Google Patents machine translation printed Nov. 28, 2025, Oct. 5, 2015, entire translation (Year: 2015).*

(Continued)

*Primary Examiner* — Katherine A Christy
(74) *Attorney, Agent, or Firm* — Oblon, McClelland, Maier & Neustadt, L.L.P.

(57) ABSTRACT

A high-strength hot-dip galvannealed steel sheet may include a plating layer on a surface of a base steel sheet. The base steel sheet may satisfy a predetermined chemical composition, in a metallographic structure of the base steel sheet, wherein a volume ratio of martensite (including tempered martensite and self-tempered martensite) is 82 vol % or more, a volume ratio of ferrite, pearlite and bainite is 13 vol % or less in total, and volume ratio of retained austenite is 5 vol % or less, in an image obtained by observing the metallographic structure of the base steel sheet with a scanning electron microscope, the number of laths at a total length of 300 μm, the number being measured by an
(Continued)

intercept method is 200 or more, a yield strength is 970 MPa or more, and a tensile strength is 1,470 MPa or more.

20 Claims, 5 Drawing Sheets

(51) Int. Cl.

| | |
|---|---|
| ***C21D 8/0247*** | (2026.01) |
| ***C21D 9/46*** | (2006.01) |
| ***C22C 38/00*** | (2006.01) |
| ***C22C 38/02*** | (2006.01) |
| ***C22C 38/06*** | (2006.01) |
| ***C22C 38/42*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |
| ***C22C 38/54*** | (2006.01) |
| ***C22C 38/58*** | (2006.01) |
| ***C22C 38/60*** | (2006.01) |
| ***C23C 2/40*** | (2006.01) |

(52) U.S. Cl.
CPC ..... *C21D 8/0247* (2013.01); *C21D 9/46* (2013.01); *C22C 38/001* (2013.01); *C22C 38/002* (2013.01); *C22C 38/005* (2013.01); *C22C 38/02* (2013.01); *C22C 38/06* (2013.01); *C22C 38/42* (2013.01); *C22C 38/44* (2013.01); *C22C 38/46* (2013.01); *C22C 38/48* (2013.01); *C22C 38/50* (2013.01); *C22C 38/54* (2013.01); *C22C 38/58* (2013.01); *C22C 38/60* (2013.01); *C23C 2/40* (2013.01); *C21D 2211/001* (2013.01); *C21D 2211/002* (2013.01); *C21D 2211/005* (2013.01); *C21D 2211/008* (2013.01); *C21D 2211/009* (2013.01)

(58) Field of Classification Search
CPC ..... C22C 38/005; C22C 38/02; C22C 38/06; C22C 38/42; C22C 38/44; C22C 38/46; C22C 38/48; C22C 38/50; C22C 38/54; C22C 38/58; C22C 38/60; C21D 2211/001; C21D 2211/002; C21D 2211/005; C21D 2211/008; C21D 2211/009
USPC ..... 428/659
See application file for complete search history.

(56) References Cited

U.S. PATENT DOCUMENTS

2021/0115542 A1 4/2021 Tsunezawa et al.
2022/0195552 A1 6/2022 Minami et al.

FOREIGN PATENT DOCUMENTS

JP 2015175050 A * 10/2015
WO WO-2019188190 A1 * 10/2019 ..... B32B 15/013

OTHER PUBLICATIONS

International Search Report mailed on Jul. 12, 2022 in PCT/JP2022/020394 filed on May 16, 2022 therein, 2 pages.
M. Tumuluru, "Effect of Silicon and Retained Austenite on the Liquid Metal Embrittlement Cracking Behavior of GEN3 and High-Strength Automotive Steels", Welding Journal, vol. 98, pp. 351-364, Dec. 2019, 14 pages.

* cited by examiner

HIGH-STRENGTH ALLOYED HOT-DIP GALVANIZED STEEL SHEET AND MANUFACTURING METHOD THEREFOR

CROSS-REFERENCE TO RELATED APPLICATIONS

The present application is the national stage of international application PCT/JP2022/020394, filed on May 16, 2022, and claims the benefit of the filing date of Japanese Appl. No. 2021-088740, filed on May 26, 2021, and Japanese Appl. No. 2021-142112, filed on Sep. 1, 2021.

TECHNICAL FIELD

The present invention relates to a high-strength hot-dip galvannealed steel sheet having an hot-dip galvannealed layer on the surface of a high-strength cold-rolled steel sheet, and a method for manufacturing the high-strength hot-dip galvannealed steel sheet.

BACKGROUND ART

A steel sheet applied to members for vehicle body structure of automobiles is required to have high impact absorption energy from the viewpoint of collision safety.

Here, in the steel sheet, it is known that as the tensile strength TS is higher and the 0.2% proof stress $\sigma_{0.2}$ or the upper yield point UYP is higher, the impact absorption energy of the steel sheet is higher. Hereinafter, the tensile strength TS of the steel sheet is simply referred to as "tensile strength", and the 0.2% proof stress $\sigma_{0.2}$ and the upper yield point UYP are also collectively referred to as "yield strength".

Therefore, the steel sheet applied to members for vehicle body structure of automobiles is required to have high tensile strength and high yield strength. In order to meet the demand for high tensile strength and yield strength for such a steel sheet, an increase in the type of components constituting the steel sheet, that is, an increase in the content of the additive element in the steel sheet is progressing. Such an increase in the content of the additive element is also progressing in a base steel sheet used for a galvanized steel sheet.

However, with the increase in the type of components constituting the steel sheet, liquid metal embrittlement (LME) cracking disadvantageously occurs in a welded part of the steel sheet. Zinc in the plating layer is melted by heat applied to the galvanized steel sheet during welding of the galvanized steel sheet or the like. When molten zinc enters the crystal grain boundary of the base steel sheet of the welded part and tensile stress acts on the welded part due to thermal shrinkage of the base steel sheet after welding or the like, cracking occurs at the crystal grain boundary of the welded part. The cracking that occurs in the welded part of the steel sheet in this manner is hereinafter referred to as "LME cracking".

Therefore, the steel sheet applied to members for vehicle body structure of automobiles is currently required to have high tensile strength and high yield strength and excellent LME cracking resistance.

Regarding the tensile strength among these required characteristics, for example, Patent Literature 1 discloses a high-strength steel sheet containing 80% or more of auto-tempered martensite as a steel structure in terms of area ratio, satisfying less than 5% of ferrite, 10% or less of bainite, and 5% or less of retained austenite, wherein the average number of iron-based carbides of 5 nm or more and 0.5 μm or less precipitated in the auto-tempered martensite is $5\times10^4$ or more per 1 $mm^2$, and the tensile strength is 1,400 MPa or more. Patent Literature 2 discloses a high-strength steel sheet containing 93 vol % or more of martensite, 2 vol % or less of ferrite, pearlite, and bainite in total, and 7 vol % or less of retained austenite with respect to the entire metallographic structure, wherein in an image obtained by observing the metallographic structure with a scanning electron microscope, the number of laths in martensite, the number being measured by the intercept method at a total length of 300 μm is 240 or more, and the tensile strength is 1,470 MPa or more.

Regarding LME cracking, Patent Literature 3 proposes, as a resistance spot welding method capable of suppressing occurrence of LME cracking, a resistance spot welding method in which three welding pulses are used in one spot welding plan, a first welding pulse and a second welding pulse are used for generation of a nugget and suppression of occurrence of liquid metal embrittlement cracking, the first welding pulse generates a nugget having a diameter of 3.75 $T^{1/2}$ to 4.25 $T^{1/2}$ (wherein T represents the thickness of the steel sheet), the second welding pulse slowly grows the nugget, and a third welding pulse that is a tempering pulse is used for improving the plasticity of the welding spot. Patent Literature 4 proposes a technique of setting the thickness of the surface layer softened part of the steel sheet to 5 μm or more, thereby achieving excellent LME resistance characteristics.

However, Patent Literatures 1 and 2 examine only the formability or the yield strength in addition to the tensile strength of the steel sheet, and do not consider the LME cracking resistance.

In addition, the spot welding method proposed in Patent Literature 3 does not consider a case where various sheet sets including three or more steel sheets are welded or a case where a disturbance condition is applied during welding, and in such a case, there is a possibility that the occurrence of LME cracking cannot be suppressed. In the technique disclosed in Patent Literature 4, the tensile strength of the resulting steel sheet is only less than 1,150 MPa. Patent Literature 4 does not consider countermeasures for the LME cracking resistance of a high-strength material having a tensile strength of 1,150 MPa or more.

The present invention has been made in view of such problems, and an object of the present invention is to provide a high-strength hot-dip galvannealed steel sheet having a yield strength of 970 MPa or more and a tensile strength of 1,470 MPa or more, and excellent LME cracking resistance, and a method for manufacturing such a high-strength hot-dip galvannealed steel sheet.

CITATION LIST

Patent Literatures

Patent Literature 1: Japanese Patent No. 5365216
Patent Literature 2: JP 2019-173156 A
Patent Literature 3: JP 2019-536631 A
Patent Literature 4: Japanese Patent No. 6787535

SUMMARY OF INVENTION

As a result of various studies, the present inventors have found that the above objects are achieved by the following inventions.

A high-strength hot-dip galvannealed steel sheet according to one aspect of the present invention is a high-strength hot-dip galvannealed steel sheet including a plating layer on a surface of a base steel sheet, wherein the base steel sheet contains, in mass %, C: 0.19 to 0.30%, Si: more than 0% and 0.70% or less, Mn: 1.8 to 3.0%, P: more than 0% and 0.020% or less, S: more than 0% and 0.05% or less, Al: 0.015 to 0.060%, Cr: 0.05 to 0.8%, Ti: 0.015 to 0.080%, B: 0.0010 to 0.0150%, Mo: more than 0% and 0.40% or less, N: 0.0100% or less, and O: 0.0030% or less, the balance including iron and unavoidable impurities, an amount of Cr [Cr] (mass %) and an amount of Si [Si] (mass %) of the base steel sheet satisfy $2\times[Cr]-[Si] \geq 0.1$, in a metallographic structure of the base steel sheet, a volume ratio of martensite (including tempered martensite and self-tempered martensite) is 82 vol % or more, a volume ratio of ferrite, pearlite and bainite is 13 vol % or less in total, and a volume ratio of retained austenite is 5 vol % or less, in an image obtained by observing the metallographic structure of the base steel sheet with a scanning electron microscope, a number of laths at a total length of 300 μm, the number being measured by an intercept method is 200 or more, a yield strength is 970 MPa or more, and a tensile strength is 1,470 MPa or more.

A method for manufacturing a high-strength hot-dip galvannealed steel sheet according to another aspect of the present invention includes:

hot-rolling a slab having the above composition;

coiling, at 620° C. or higher, a hot-rolled steel sheet obtained by hot rolling;

uncoiling the hot-rolled steel sheet coiled, and cold-rolling the hot-rolled steel sheet uncoiled;

heating a cold-rolled steel sheet obtained by cold rolling, holding the cold-rolled steel sheet for 11 s or more in a temperature range of the Ac3 point or higher, cooling, the cold-rolled steel sheet heated and held, to a temperature range of 540 to 580° C. at an average cooling rate of 3° C./s or more, and further cooling the cold-rolled steel sheet to a temperature range of 410 to 480° C. within 90 s;

hot-dip galvanizing a base steel sheet obtained by cooling the cold-rolled steel sheet;

heating, a hot-dip galvanized steel sheet obtained by hot-dip galvanizing, to a temperature range of 550° C. or lower to perform alloying treatment of the hot-dip galvanizing; and cooling, a hot-dip galvannealed steel sheet obtained by performing alloying treatment of the hot-dip galvanizing, to a temperature range of 230 to 340° C. at an average cooling rate of 5° C./s or more.

DESCRIPTION OF EMBODIMENTS

Figure 1:
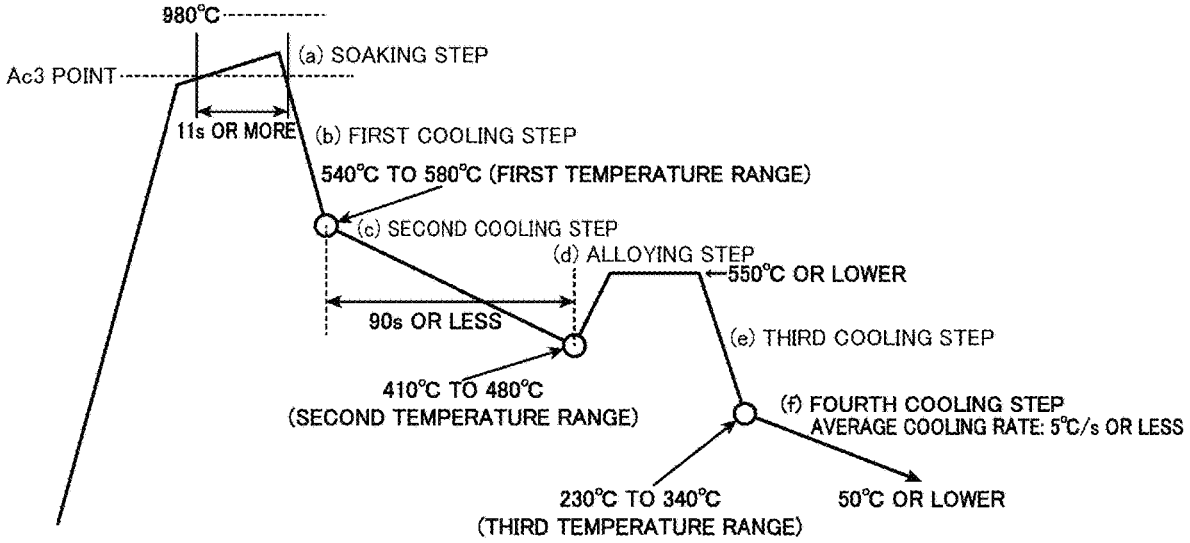
FIG. 1 is a schematic view of a heat pattern of an annealing step according to an embodiment of the present invention.

Hereinafter, a high-strength hot-dip galvannealed steel sheet according to an embodiment of the present invention will be described.

The high-strength hot-dip galvannealed steel sheet according to the present embodiment is a high-strength hot-dip galvannealed steel sheet including a plating layer on the surface of a base steel sheet. Hereinafter, each component of the high-strength hot-dip galvannealed steel sheet will be described. A high-strength hot-dip galvannealed steel sheet having the following configuration has a yield strength of 970 MPa or more and a tensile strength of 1,470 MPa or more, and has excellent LME cracking resistance.

(Base Steel Sheet)

The base steel sheet of the high-strength hot-dip galvannealed steel sheet according to the present embodiment has the following chemical composition. "%" in the following description of the chemical composition means "mass %". Hereinafter, the base steel sheet and the high-strength hot-dip galvannealed steel sheet are also collectively referred to simply as "steel sheet". The tensile strength TS of the steel sheet is simply referred to as "tensile strength", and the 0.2% proof stress $\sigma_{0.2}$ and the upper yield point UYP are also collectively referred to as "yield strength". The "tensile strength" and the "yield strength" are also collectively and simply referred to as "strength".

(C: 0.19 to 0.30%)

C is an element necessary for securing the strength of the steel sheet. When the amount of C is insufficient, the tensile strength of the steel sheet decreases. In order to secure sufficient strength of the steel sheet, the amount of C is 0.19% or more. The lower limit of the amount of C is preferably 0.20% or more, and more preferably 0.21% or more. However, when the amount of C is excessive, the volume ratio of retained austenite becomes excessive, which may cause a decrease in the yield strength of the steel sheet. Therefore, the amount of C is set to 0.30% or less. The upper limit of the amount of C is preferably 0.290% or less, more preferably 0.280% or less, still more preferably 0.270% or less, and still more preferably 0.260% or less.

(Si: More than 0% and 0.70% or Less)

Si is one of important elements in the present invention. Si is known as a solid-solution strengthening element and is an element that effectively acts to improve the tensile strength while controlling the decrease in the ductility of the steel sheet. Si is also an element having an effect of increasing the temper softening resistance of the martensite structure. In order to allow these effects to be effectively exhibited, the amount of Si is set to an amount exceeding 0%. The lower limit of the amount of Si is preferably 0.06% or more. The lower limit of the amount of Si is more preferably 0.07% or more, and still more preferably 0.08% or more. However, when the amount of Si is excessive, the volume ratio of retained austenite becomes excessive, which may cause a decrease in the yield strength of the steel sheet. In addition, when the amount of Si is excessive, there is a possibility that the LME cracking resistance of the steel sheet is deteriorated. Therefore, the amount of Si is set to 0.70% or less. The upper limit of the amount of Si is preferably 0.60% or less, and more preferably 0.50% or less.

(Mn: 1.8 to 3.0%)

Mn is an element that contributes to strengthening of the steel sheet. In order to allow such an effect to be effectively exhibited, the amount of Mn is set to 1.8% or more. The lower limit of the amount of Mn is preferably 1.9% or more, and more preferably 2.0% or more. However, when the amount of Mn is excessive, slab breakage, an increase in cold rolling load, and the like may be caused. Therefore, the amount of Mn is 3.0% or less. The upper limit of the amount of Mn is preferably 2.9% or less, and more preferably 2.8% or less.

(P: More than 0% and 0.020% or Less)

P is an element unavoidably contained in steel, and segregates at crystal grain boundaries of steel to promote grain boundary embrittlement. The amount of P is preferably reduced as much as possible in order to avoid breakage or the like during working of the steel sheet. Therefore, the amount of P is set to 0.020% or less. The upper limit of the amount of P is preferably 0.015% or less, and more preferably 0.012% or less. P is an impurity unavoidably mixed in steel as described above, and it is impossible to reduce the amount of P to 0% in industrial production.

(S: More than 0% and 0.05% or Less)

Similarly to P, S is an element unavoidably contained in steel. S forms inclusions together with other elements in steel. The inclusion may cause breakage or the like during working of the steel sheet. In order to avoid such breakage of the steel sheet or the like, it is preferable to reduce the amount of S as much as possible. Therefore, the amount of S is set to 0.05% or less. The upper limit of the amount of S is preferably 0.04% or less, and more preferably 0.03% or less. Similarly to P, it is impossible to set the amount of S to 0% in industrial production.

(Al: 0.015 to 0.060%)

Al is an element that acts as a deoxidizer in steel. In order to allow such an action to be effectively exhibited, the amount of Al is set to 0.015% or more. The lower limit of the amount of Al is preferably 0.025% or more, and more preferably 0.030% or more. However, when the amount of Al is excessive, a large amount of inclusions such as alumina is generated in the steel sheet, which may cause breakage during working of the steel sheet. Therefore, the amount of Al is 0.060% or less. The upper limit of the amount of Al is preferably 0.055% or less, and more preferably 0.050% or less.

(Cr: 0.05 to 0.8%)

Cr is one of important elements in the present invention. Cr is an element that contributes to strengthening of the steel sheet. Specifically, Cr is an element that improves the hardenability of the steel sheet, reduces bainite generated during quenching, increases the number of laths of martensite, and effectively acts on increasing the strengthening of the steel sheet. Furthermore, Cr is an element that hardly deteriorates LME cracking resistance even when the content of Cr is increased. In order to allow these effects to be effectively exhibited, the amount of Cr is set to 0.05% or more. The lower limit of the amount of Cr is preferably 0.1% or more. However, when the amount of Cr is excessive, bare spots may be generated in a hot-dip galvanized steel sheet or an hot-dip galvannealed steel sheet. Therefore, the amount of Cr is set to 0.8% or less. The upper limit of the amount of Cr is preferably 0.7% or less, and more preferably 0.6% or less.

(Ti: 0.015 to 0.080%)

Ti is an element that forms a carbide or a nitride to improve the strength of the steel sheet. Ti is an element that is effective also in allowing the below-described hardenability improving effect produced by B to be effectively exhibited. That is, Ti reduces N in steel by forming a nitride. As a result, the formation of B nitride is suppressed, and B forms a solid solution state, so that the hardenability improving effect produced by B can be effectively exhibited. As described above, Ti enhances the hardenability improvement of the steel sheet by B, to thereby contribute to strengthening of the steel sheet. In order to allow such an effect to be effectively exhibited, the amount of Ti is set to 0.015% or more. The lower limit of the amount of Ti is preferably 0.018% or more, and more preferably 0.020% or more. However, when the amount of Ti is excessive, the amount of Ti carbide or Ti nitride is excessive, which may cause cracking during working of the steel sheet. Therefore, the amount of Ti is set to 0.080% or less. The upper limit of the amount of Ti is preferably 0.070% or less, and more preferably 0.060% or less.

(B: 0.0010 to 0.0150%)

B is an element that improves the hardenability to contributes to strengthening of the steel sheet. In order to allow such an effect to be effectively exhibited, the amount of B is set to 0.0010% or more. The lower limit of the amount of B is preferably 0.0012% or more, and more preferably 0.0014% or more. However, when the amount of B is excessive, the effect thereof is saturated, so that only the cost increases. Therefore, the amount of B is set to 0.0150% or less. The upper limit of the amount of B is preferably 0.0140% or less.

(Mo: more than 0% and 0.40% or less)

Mo is an element that contributes to strengthening of the steel sheet. The effect thereof increases as the amount of Mo increases. In order to allow these effects to be effectively exhibited, the amount of Mo is set to more than 0%. The lower limit of the amount of Mo is preferably 0.10% or more, and more preferably 0.20% or more. However, when the amount of Mo is excessive, the effect thereof is saturated and the cost increases. Therefore, the amount of Mo is set to 0.40%. The upper limit of the amount of Mo is preferably 0.30% or less.

(Relationship Between Amount of Si and Amount of Cr)

The amount of Cr and the amount of Si in the base steel sheet of the high-strength hot-dip galvannealed steel sheet according to the present embodiment satisfy the following Formula (1). By satisfying Formula (1), the hardenability of the high-strength hot-dip galvannealed steel sheet can be improved. By improving the hardenability, the amounts of ferrite and bainite generated during quenching can be limited. In addition, by satisfying Formula (1), the balance between the amount of Si and the amount of Cr becomes appropriate, so that the occurrence of LME cracking in a region around the welded part can be reduced. That is, it is possible to achieve both strengthening of the high-strength hot-dip galvannealed steel sheet and excellent LME cracking resistance.

$$2 \times [Cr] - [Si] \geq 0.1 \quad (1)$$

In Formula (1), [element symbol] is the content (mass %) of each element of the base steel sheet.

(Balance)

The basic components of the base steel sheet of the high-strength hot-dip galvannealed steel sheet according to the present embodiment are as described above, and the balance is substantially iron. However, it is naturally allowable that impurities unavoidably brought in depending on the circumstances of raw materials, facility materials, manufacturing equipment, and the like are contained in steel. That is, the balance of the basic components of the base steel sheet consists of iron and unavoidable impurities. Examples of such unavoidable impurities include N and O in addition to P and S described above. The amounts of N and O are preferably in the following ranges, respectively.

(N: 0.0100% or less)

N is an impurity element unavoidably contained in steel. When the amount of N is excessive, there is possibility that cracking occurs during working of the steel sheet. Therefore, the amount of N is 0.0100% or less. The upper limit of the amount of N is preferably 0.0060% or less. It is difficult to reduce the amount of N to 0% in industrial production.

(O: 0.0030% or less)

O is an impurity element unavoidably contained in steel. When the amount of O is excessive, there is possibility that cracking occurs during working of the steel sheet. Therefore, the amount of O is 0.0030% or less. The upper limit of the amount of O is preferably 0.0020% or less. It is difficult to reduce the amount of O to 0% in industrial production.

(Optional Element)

The base steel sheet of the high-strength hot-dip galvannealed steel sheet according to the present embodiment may contain Ca in the following range as necessary. The base steel sheet may contain one or more elements selected from the group consisting of Nb, V, Cu, Ni, Mg, and a rare earth element (REM) together with or without containing Ca in the following ranges. By incorporating these elements alone or in appropriate combination, the characteristics of the base steel sheet are further improved depending on the elements contained.

(Ca: More than 0% and 0.0040% or Less)

Ca is an element effective for spheroidizing sulfides in steel and enhancing the bendability of the steel sheet. The effect thereof is exhibited when the amount of Ca exceeds 0%, and increases as the amount of Ca increases. In order to allow the effect to be more effectively exhibited, the lower limit of the amount of Ca is preferably 0.0005% or more, and more preferably 0.0010% or more. However, when the amount of Ca is excessive, the effect thereof is saturated and the cost increases. Therefore, the upper limit of the amount of Ca is preferably 0.0040% or less, and more preferably 0.0030% or less.

(Nb: More than 0% and 0.020% or Less)

Nb is an element that contributes to strengthening of the steel sheet. The effect thereof is exhibited when the amount of Nb exceeds 0%, and increases as the amount of Nb increases. In order to allow the effect to be effectively exhibited, the lower limit of the amount of Nb is preferably 0.003% or more, and more preferably 0.005% or more. However, when the amount of Nb is excessive, the hardenability of the steel sheet is deteriorated. Therefore, the upper limit of the amount of Nb is preferably 0.020% or less, more preferably 0.018% or less, and still more preferably 0.015% or less.

(V: More than 0% and 0.30% or Less)

V is an element that contributes to strengthening of the steel sheet. The effect thereof is exhibited when the amount of V exceeds 0%, and increases as the amount of V increases. In order to allow the effect to be effectively exhibited, the lower limit of the amount of V is preferably 0.005% or more, and more preferably 0.010% or more. However, when the amount of V is excessive, the effect thereof is saturated and the cost increases. Therefore, the upper limit of the amount of V is preferably 0.30% or less, more preferably 0.25% or less, and still more preferably 0.20% or less.

(Cu: More than 0% and 0.30% or Less)

Cu is an element effective for improving the corrosion resistance of the steel sheet. The effect thereof is exhibited when the amount of Cu exceeds 0%, and increases as the amount of Cu increases. In order to allow the effect to be effectively exhibited, the lower limit of the amount of Cu is preferably 0.01% or more, and more preferably 0.05% or more. However, when the amount of Cu is excessive, the effect thereof is saturated and the cost increases. Therefore, the upper limit of the amount of Cu is preferably 0.30% or less, more preferably 0.20% or less, and still more preferably 0.15% or less.

(Ni: More than 0% and 0.30% or Less)

Ni is an element effective for improving the corrosion resistance of the steel sheet. The effect thereof is exhibited when the amount of Ni exceeds 0%, and increases as the amount of Ni increases. In order to allow the effect to be effectively exhibited, the lower limit of the amount of Ni is preferably 0.03% or more, and more preferably 0.05% or more. However, when the amount of Ni is excessive, the effect thereof is saturated and the cost increases. Therefore, the upper limit of the amount of Ni is preferably 0.30% or less, more preferably 0.20% or less, and still more preferably 0.15% or less.

(Mg: More than 0% and 0.0100% or Less)

Mg is an element that contributes to improvement of the formability of the steel sheet. The effect thereof is exhibited when the amount of Mg exceeds 0%. However, when the amount of Mg is excessive, the pickling properties, weldability, hot formability, and economic efficiency of the steel sheet deteriorate. Therefore, the upper limit of the amount of Mg is preferably 0.0100% or less, and more preferably 0.0040% or less.

(REM: More than 0% and 0.010% or Less)

The REM is an element that contributes to improvement of the formability of the steel sheet. The effect thereof is exhibited when the amount of the REM exceeds 0%. However, when the amount of the REM is excessive, the pickling properties, weldability, hot formability, and economic efficiency of the steel sheet deteriorate. Therefore, the upper limit of the amount of the REM is preferably 0.010% or less, and more preferably 0.0040% or less.

(Metallographic Structure of Base Steel Sheet)

The metallographic structure of the base steel sheet of the high-strength hot-dip galvannealed steel sheet according to the present embodiment contains 82 vol % or more of martensite (including tempered martensite and self-tempered martensite), 13 vol % or less of bainite, and 5 vol % or less of retained austenite. Thus, the high-strength hot-dip galvannealed steel sheet according to the present embodiment can have a prescribed tensile strength and yield strength. The method for measuring the proportion of each metallographic structure can be the methods described in Examples described later.

(Martensite: 82 Vol % or More)

The martensite in the metallographic structure is a matrix structure of the base steel sheet according to the present embodiment. By setting the volume ratio of martensite to 82 vol % or more with respect to the entire metallographic structure of the base steel sheet, the yield strength and tensile strength of the steel sheet are increased. When the volume ratio of martensite is less than 82 vol %, other soft structures start plastic deformation at low stress, and the yield strength and tensile strength of the steel sheet decrease. The volume ratio of martensite is more preferably 83 vol % or more. There is no upper limit on the volume ratio of martensite, and the volume ratio may be 100%. The martensite of the present embodiment includes not only as-quenched martensite but also tempered martensite and self-tempered martensite (auto-tempered martensite).

(Ferrite, Pearlite, and Bainite: 13 Vol % or Less in Total)

Ferrite, pearlite and bainite are softer than martensite which is the matrix structure of the base steel sheet. When these structures increase in the steel sheet, these structures start plastic deformation at low stress, and the yield strength and tensile strength of the steel sheet decrease. From such a viewpoint, the volume ratio of ferrite, pearlite, and bainite is set to 13 vol % or less in total with respect to the entire metallographic structure of the base steel sheet. There is no lower limit on the volume ratio of ferrite, pearlite and bainite, and the volume ratio may be 0 vol %. Hereinafter, ferrite, pearlite, and bainite are also collectively referred to as "bainite and the like".

(Retained Austenite: 5 Vol % or Less)

The volume ratio of retained austenite in the metallographic structure is set to 5 vol % or less with respect to the entire metallographic structure of the base steel sheet. Among the retained austenite, a small amount of film-like retained austenite existing at the boundary of the lath of martensite has an effect of increasing the tensile strength and the yield strength by suppressing the movement of dislocations when stress is applied to the steel sheet. However, retained austenite itself is softer than the martensite structure. Therefore, when retained austenite is excessively present even in the form of a film, both the yield strength and the tensile strength of the steel sheet decrease. From such a viewpoint, the volume ratio of retained austenite is set to 5 vol % or less. The volume ratio of retained austenite may be 0 vol %.

As described in Examples described later, the proportion of retained austenite can be measured by polishing a ground surface of a test piece cut out from a base steel sheet by chemical polishing or electrolytic polishing, and applying X-ray diffraction to the ground surface after polishing. As a method for polishing the ground surface, electrolytic polishing is preferable rather than chemical polishing from the viewpoint of reducing the load on the environment.

(Number of Laths at Total Length of 300 μm Measured by Intercept Method is 200 or More)

The base steel sheet of the high-strength hot-dip galvannealed steel sheet according to the present embodiment satisfies high tensile strength and high yield strength. Therefore, in an image obtained by observing the metallographic structure of the base steel sheet with a scanning electron microscope, the number of laths at a total length of 300 μm, the number being measured by the intercept method (hereinafter, also simply referred to as "the number of laths at a total length of 300 μm") is set to 200 or more. When the number of laths at a total length of 300 μm is less than 200, at least one of the yield strength and the tensile strength decreases. The number of laths at a total length of 300 μm is preferably 210 or more, and more preferably 220 or more.

The "lath" as used herein is a lower structure of martensite, and is a crystal extended in one direction. The structure of martensite is multilayered as described below. Martensite is formed by transformation of quenched austenite. In one prior austenite grain, there are a plurality of packets that are an aggregate of grains having the same crystal habit plane. Inside each packet, there is a block that is a parallel band-shaped region. Furthermore, each block has aggregates of laths involving high-density dislocation in approximately the same crystal orientation.

The "number of laths at a total length of 300 μm, the number being measured by the intercept method" as defined in the present invention is measured at ¼ of the thickness of a cross section parallel to the rolling direction of the steel sheet. Specifically, the cross section of the polished steel sheet is subjected to corrosion using nital, and a photograph of the cross section is taken at a magnification of 3,000 using a field emission scanning electron microscope (FE-SEM). The number of laths is measured by applying the intercept method to this photograph. The intercept method in the present embodiment is a method of drawing a line having a total length of 300 μm (a test line of a straight line or an arc) on a taken FE-SEM image and obtaining the number of laths intersecting the test line. A method for measuring the number of laths by the intercept method will be described more specifically in Examples described later.

(Plating Layer)

The plating layer is formed by subjecting hot-dip galvanizing formed on the surface of the base steel sheet to alloying treatment described later. The hot-dip galvanizing is not particularly limited, and commonly used ones can be applied.

(Method for Manufacturing High-Strength Hot-Dip Galvannealed Steel Sheet)

A method for manufacturing a high-strength hot-dip galvannealed steel sheet according to the present embodiment will be described.

The high-strength hot-dip galvannealed steel sheet according to the present embodiment satisfying the above requirements is obtained by hot-rolling a slab having the composition of the above-described base steel sheet, coiling the hot-rolled steel sheet at a predetermined temperature, uncoiling the coiled hot-rolled steel sheet, cold-rolling the uncoiled hot-rolled steel sheet, annealing the cold-rolled steel sheet obtained by cold rolling, hot-dip galvanizing a base steel sheet obtained by cooling the cold-rolled steel sheet after annealing, performing alloying treatment on the hot-dip galvanized steel sheet obtained by hot-dip galvanizing, and then cooling the hot-dip galvannealed steel sheet. Each step will be described below.

(Hot Rolling Step)

The conditions for the hot rolling are, for example, as follows. In the hot rolling step, a slab having the above-described composition of the steel sheet is hot-rolled. When the heating temperature of the slab before hot rolling is low, carbides such as TiC may be difficult to be dissolved in solid in austenite. Therefore, the heating temperature of the slab before hot rolling is preferably 1,100° C. or higher. The heating temperature of the slab before hot rolling is more preferably 1,200° C. or higher. However, when the heating temperature before hot rolling is excessively high, the cost increases. Therefore, the upper limit of the heating temperature before hot rolling is preferably 1,350° C. or lower, and more preferably 1,300° C. or lower.

When the finish rolling temperature of hot rolling is low, the deformation resistance of the slab during rolling increases, so that the operation may be difficult. Therefore, the finish rolling temperature is preferably 850° C. or higher, and more preferably 870° C. or higher. However, when the finish rolling temperature is excessively high, the strength of the hot-rolled steel sheet may be excessively high. Therefore, the finish rolling temperature is preferably 980° C. or lower, and more preferably 950° C. or lower.

The average cooling rate from finish rolling to coiling of the hot-rolled steel sheet obtained by hot rolling is preferably 10° C./s or more and more preferably 20° C./s or more in consideration of the productivity. On the other hand, when the average cooling rate is excessively high, the facility cost increases. Therefore, the average cooling rate is preferably 100° C./s or less, and more preferably 50° C./s or less.

(Coiling Step of Hot-Rolled Steel Sheet)

The hot-rolled steel sheet obtained by hot rolling is coiled at 620° C. or higher. When the coiling temperature of the hot-rolled steel sheet is lower than 620° C., the strength of the hot-rolled steel sheet becomes excessively high, and cold rolling becomes difficult. The coiling temperature of the hot-rolled steel sheet is preferably 630° C. or higher, and more preferably 640° C. or higher. On the other hand, when the coiling temperature of the hot-rolled steel sheet is excessively high, the pickling properties for scale removal deteriorate. Therefore, the coiling temperature is preferably 800° C. or lower, and more preferably 750° C. or lower.

(Cold Rolling Step)

The coiled hot-rolled steel sheet is uncoiled and then cold-rolled. The uncoiled hot-rolled steel sheet is pickled for scale removal as necessary.

The lower limit of the rolling rate during cold rolling is preferably 10% or more. The rolling rate in the present embodiment is synonymous with "draft". Specifically, when the thickness of the steel sheet before rolling is h1 and the thickness of the steel sheet after rolling is h2, the rolling rate (%) is "(h1−h2)/h1×100". When the rolling rate during cold rolling is less than 10%, in order to obtain a steel sheet having a predetermined thickness, it is necessary to reduce the thickness of the hot-rolled steel sheet in the hot rolling step. When the thickness of the hot-rolled steel sheet is reduced, the length of the hot-rolled steel sheet is increased, so that pickling takes time and the productivity deteriorates. The lower limit of the rolling rate during cold rolling is more preferably 25% or more.

On the other hand, when the rolling rate during cold rolling exceeds 70%, a high-performance cold-rolling mill is required. Therefore, the upper limit of the rolling rate during cold rolling is preferably 70% or less, and more preferably 65% or less.

FIG. 1 is a schematic view of a heat pattern of a steel sheet after cold rolling according to the present embodiment. The heat pattern illustrated in FIG. 1 includes (a) a soaking step, (b) a first cooling step, (c) a second cooling step, (d) an alloying step, (e) a third cooling step, and (f) a fourth cooling step. In order to obtain the high-strength hot-dip galvannealed steel sheet according to the present embodiment, it is particularly important to appropriately adjust the conditions of the respective steps (a) to (e) among the steps included in the heat pattern after cold rolling.

(a) Soaking Step

In the soaking step, the cold-rolled steel sheet is heated and held for 11 s or more in a temperature range of the Ac3 point or more. When the heating temperature is lower than the Ac3 point, soft ferrite that reduces the yield strength and tensile strength of the steel sheet may remain. Therefore, the lower limit of the holding temperature in the soaking step is set to the Ac3 point. The lower limit of the holding temperature in the soaking step is preferably (Ac3 point+5° C.) The holding temperature in the soaking step may be equal to or lower than the solidus temperature of the cold-rolled steel sheet, and the upper limit thereof is not particularly set. However, when the holding temperature in the soaking step is excessively increased, the productivity is deteriorated, or economic efficiency is deteriorated due to an increase in fuel consumption of the furnace. Therefore, the upper limit of the holding temperature in the soaking step is preferably 980° C. or lower. In the soaking step, the temperature of the cold-rolled steel sheet may be kept constant, and the temperature of the cold-rolled steel sheet may vary as long as the holding temperature is within the above range.

In addition, when the holding time in the temperature range of the Ac3 point or higher is less than 11 s, the amount of elements to be dissolved in solid in the steel sheet in the soaking step is insufficient in the carbide present in the cold-rolled steel sheet before heating and the elements dissolved in solid in the carbide, and the hardenability is deteriorated. Therefore, the holding time in the temperature range of the Ac3 point or higher is 11 s or more. The lower limit of the holding time in the temperature range of the Ac3 point or higher is preferably 12 s or more, and more preferably 15 s. The upper limit of the holding time in the temperature range of the Ac3 point or higher is not particularly provided. However, when the holding time is excessively long, the productivity is deteriorated, and thus the holding time is preferably less than 600 s.

The Ac3 point can be calculated by the following Formula (2) (William C. Leslie, "The Physical Metallurgy of Steels", Maruzen Co., Ltd., p. 273). [Element symbol] in Formula (2) represents the content (mass %) of each element.

$$\begin{aligned} Ac3\ (^\circ\ C.) = {} & 910 - 203\times[C]^{1/2} - 15.2\times[Ni] + 44.7\times[Si] + \\ & 104\times[V] + 31.5\times[Mo] + 13.1\times[W] - \{30\times[Mn] + 11\times[Cr] + \\ & 20\times[Cu] - 700\times[P] - 400\times[Al] - 120\times[As] - 400\times[Ti]\} \end{aligned} \quad (2)$$

(b) First Cooling Step

In the first cooling step, the cold-rolled steel sheet heated and held in a temperature range of the Ac3 point or higher in the soaking step is cooled to a temperature range of 540 to 580° C. (first temperature range) at an average cooling rate of 3° C./s or more. Specifically, after cooling is started in the soaking step, cooling is performed from the Ac3 point to the first temperature range at an average cooling rate of 3° C./s or more. When the average cooling rate is less than 3° C./s, there is a high possibility that ferrite is generated, so that it is difficult to secure the yield strength and tensile strength defined in the present invention. Therefore, the average cooling rate needs to be 3° C./s or more, preferably 4° C./s or more, and more preferably 5° C./s or more. On the other hand, although the upper limit is not particularly provided, when the average cooling rate exceeds 50° C./s, it is difficult to control the temperature of the steel sheet, and the facility cost increases. Therefore, the upper limit of the average cooling rate is 50° C./s or less, and preferably 40° C./s or less.

(c) Second Cooling Step

In the second cooling step, after the first cooling step, the cold-rolled steel sheet is cooled to a temperature range of 410 to 480° C. (second temperature range) within 90 s to obtain a base steel sheet. More specifically, the cold-rolled steel sheet is cooled from the first temperature range to the second temperature range within 90 s or less while securing a temperature equal to or higher than the Ms point. When the time for cooling from the first temperature range to the second temperature range exceeds 90 s, there is a concern about an increase in bainite. Therefore, the time for cooling from the first temperature range to the second temperature range is set to 90 s or less. The upper limit of the time for cooling from the first temperature range to the second temperature range is preferably 70 s or less. The upper limit of the second temperature range is preferably 470° C. or lower, and more preferably 460° C. or lower.

In the second cooling step, it is preferable to keep the cold-rolled steel sheet at a temperature equal to or higher than the Ms point. This is because when the temperature of the cold-rolled steel sheet is less than the Ms point in the second cooling step, martensite is generated before the subsequent alloying step, and the lath interval decreases as the final structure after the completion of the heat treatment, leading to a decrease in tensile strength.

The "Ms point" is a temperature at which austenite starts to be transformed to martensite. The Ms point can be simply obtained from the chemical composition of the steel sheet based on the following Formula (3) ("Courses of Contemporary Metallurgy, Material Part, Vol. 4, Iron and Steel Materials", The Japan Institute of Metals and Materials, June 1985, p. 45). [Element symbol] in Formula (3) represents the content (mass %) of each element in the steel sheet, and the element not contained in the steel sheet is calculated as 0.

$$Ms\ \text{point}\ (^\circ\ \text{C.}) = 550 - 361 \times [C] - 39 \times [Mn] - 35 \times [V] - 20 \times [Cr] - 17 \times [Ni] - 10 \times [Cu] - 5 \times ([Mo] + [W]) + 15 \times [Co] + 30 \times [Al] \quad (3)$$

(d) Alloying Step

After the second cooling step and prior to the alloying step, the base steel sheet is hot-dip galvanized. The base steel sheet cooled to the second temperature range is placed in a plating pot containing a hot-dip galvanizing bath, and subjected to dipping treatment in the plating bath. By this dipping treatment, the base steel sheet is hot-dip galvanized to obtain a hot-dip galvanized steel sheet. In the alloying step, the obtained hot-dip galvanized steel sheet is subjected to alloying treatment.

In the alloying step, the hot-dip galvanized steel sheet is heated to a temperature range of 550° C. or lower to perform alloying treatment of hot-dip galvanizing. Specifically, zinc contained in hot-dip galvanizing and iron contained in the base steel sheet are alloyed by heating the hot-dip galvanized steel sheet. When the heating temperature in this alloying treatment exceeds 550° C., there is an increased possibility that ferrite is generated in the base steel sheet, and the tensile strength of the hot-dip galvannealed steel sheet may decrease. In addition to this, the diffusion of iron from the base steel sheet to zinc in hot-dip galvanizing is excessive, and there is a high possibility that the plating layer is peeled off during press forming or the like. The upper limit of the heating temperature in the alloying step is preferably 540° C. or lower, and more preferably 530° C. or lower. The heating temperature in the alloying step may be higher than the temperature of the hot-dip galvanized steel sheet immediately after the dipping treatment in the plating bath, and is preferably 420° C. or higher, and more preferably 430° C. or higher.

(e) Third Cooling Step

In the third cooling step, the hot-dip galvannealed steel sheet obtained in the alloying step is cooled to a temperature range of 230 to 340° C. (third temperature range) at an average cooling rate of 5.0° C./s or more. More specifically, cooling is performed at an average cooling rate of 5.0° C./s or more from immediately after alloying to the cooling stop temperature in the third temperature range. Thus, the high-strength hot-dip galvannealed steel sheet according to the present embodiment described above can be obtained. When the average cooling rate in the third cooling step is less than 5.0° C./s, an increase in bainite is concerned. Even when generation of bainite is suppressed, the distribution of carbon from martensite generated after passing through the Ms point to untransformed austenite proceeds, whereby austenite is stabilized. When austenite is stabilized, the amount of austenite that transforms to martensite is reduced. As a result, more than 5 vol % of retained austenite is likely to be contained. Therefore, the average cooling rate in the third cooling step is set to 5.0° C./s or more. The average cooling rate in the third cooling step is preferably 8.0° C./s or more, and more preferably 10° C./s or more. Although the upper limit of the average cooling rate is not particularly defined, when the cooling capacity of the cooling facility is increased, a large load is generated in the cooling facility. Therefore, the upper limit of the average cooling rate is preferably 50° C./s or less, and more preferably 40° C./s or less.

(f) Fourth Cooling Step

The fourth cooling step is subsequently performed after the third cooling step. In the fourth cooling step, the high-strength hot-dip galvannealed steel sheet is preferably cooled at an average cooling rate of 5.0° C./s or less from the third temperature range to a cooling stop temperature of 50° C. or lower. When the average cooling rate in the fourth cooling step exceeds 5.0° C./s, self-tempering of martensite of the base steel sheet does not proceed, and a brittle structure may be formed. The average cooling rate in the fourth cooling step is more preferably 4.0° C./s or less. In addition, the average cooling rate in the fourth cooling step is preferably 0.05° C./s or more, and more preferably 0.10° C./s or more in consideration of deterioration of the productivity of the high-strength hot-dip galvannealed steel sheet.

When the cooling stop temperature in the third cooling step is higher than 230° C., the average cooling rate from the cooling stop temperature in the third cooling step to 230° C. is not limited. In the fourth cooling step, the high-strength hot-dip galvannealed steel sheet may be cooled to room temperature at any cooling rate as long as heating is not performed after the third cooling step.

(Other Steps)

After the fourth cooling step, the high-strength hot-dip galvannealed steel sheet may be worked or tempered as necessary.

The high-strength hot-dip galvannealed steel sheet cooled in the fourth cooling step has a sufficiently high tensile strength and yield strength even without temper rolling. However, it is also possible to achieve higher yield strength by subjecting the galvanized steel sheet to working such as temper rolling to cause work hardening. Such improvement in yield strength is caused by reduction in mobile dislocation of martensite in the base steel sheet due to working of the galvanized steel sheet. The mobile dislocation of martensite of the base steel sheet is preferably small because the mobile dislocation reduces the yield strength of the galvanized steel sheet. The upper limit of the amount of working of the galvanized steel sheet is not particularly defined. However, working causes deterioration in shape and anisotropy in strength of the galvanized steel sheet. Therefore, the upper limit of the amount of working in the temper rolling is preferably 5% or less, and more preferably 4% or less in terms of the elongation rate in the rolling direction of the high-strength hot-dip galvannealed steel sheet. As working other than the temper rolling, working using a leveler may be performed. A preferable amount of working in the working using a leveler is the same as that in the temper rolling.

It is also possible to achieve higher yield strength while maintaining high tensile strength by subjecting the high-strength hot-dip galvannealed steel sheet to moderate tempering. This is because the mobile dislocation of martensite of the base steel sheet is reduced by tempering, similarly to the working.

Although the tempering temperature is not particularly defined, when the tempering temperature exceeds about 500° C., excessive tempering occurs and the number of laths of martensite of the base steel sheet decreases. This causes a decrease in tensile strength and yield strength of the high-strength hot-dip galvannealed steel sheet. Therefore, the upper limit of the tempering temperature is preferably 500° C. or lower.

The high-strength hot-dip galvannealed steel sheet of the present invention is not limited to those obtained by the above-described manufacturing method. The high-strength hot-dip galvannealed steel sheet of the present invention may be those obtained by other manufacturing methods as long as the requirements defined in the present invention are satisfied.

The present specification discloses various aspects of the technology as described above. Among them, main techniques are summarized below.

As described above, the high-strength hot-dip galvannealed steel sheet according to one aspect of the present invention is a high-strength hot-dip galvannealed steel sheet including a plating layer on a surface of a base steel sheet, wherein the base steel sheet contains, in mass %, C: 0.19 to 0.30%, Si: more than 0% and 0.70% or less, Mn: 1.8 to 3.0%, P: more than 0% and 0.020% or less, S: more than 0% and 0.05% or less, Al: 0.015 to 0.060%, Cr: 0.05 to 0.8%, Ti: 0.015 to 0.080%, B: 0.0010 to 0.0150%, Mo: more than 0% and 0.40% or less, N: 0.0100% or less, and O: 0.0030% or less, the balance including iron and unavoidable impurities, an amount of Cr [Cr] (mass %) and an amount of Si [Si] (mass %) of the base steel sheet satisfy $2\chi[Cr]-[Si] \geq 0.1$, in a metallographic structure of the base steel sheet, a volume ratio of martensite (including tempered martensite and self-tempered martensite) is 82 vol % or more, a volume ratio of ferrite, pearlite and bainite is 13 vol % or less in total, and a volume ratio of retained austenite is 5 vol % or less, in an image obtained by observing the metallographic structure of the base steel sheet with a scanning electron microscope, a number of laths at a total length of 300 μm, the number being measured by an intercept method is 200 or more, a yield strength is 970 MPa or more, and a tensile strength is 1,470 MPa or more.

According to this configuration, it is possible to obtain a high-strength hot-dip galvannealed steel sheet having a yield strength of 970 MPa or more, a tensile strength of 1,470 MPa or more, and excellent LME cracking resistance.

In the high-strength hot-dip galvannealed steel sheet having the above configuration, the base steel sheet may further contain Ca: more than 0% and 0.0040% or less in mass %.

According to this configuration, a high-strength hot-dip galvannealed steel sheet excellent also in bendability can be obtained.

In the high-strength hot-dip galvannealed steel sheet having the above configuration, the base steel sheet may further contain, in mass %, one or more selected from the group consisting of Nb: more than 0% and 0.020% or less, V: more than 0% and 0.30% or less, Cu: more than 0% and 0.30% or less, Ni: more than 0% and 0.30% or less, Mg: more than 0% and 0.0100% or less, and REM: more than 0% and 0.010% or less.

According to this configuration, a high-strength hot-dip galvannealed steel sheet having further excellent strength, or excellent corrosion resistance or formability can be obtained.

In addition, a method for manufacturing a high-strength hot-dip galvannealed steel sheet according to another aspect of the present invention includes:

hot-rolling a slab having the above composition;

coiling, at 620° C. or higher, a hot-rolled steel sheet obtained by hot rolling;

uncoiling the hot-rolled steel sheet coiled, and cold-rolling the hot-rolled steel sheet uncoiled;

heating a cold-rolled steel sheet obtained by cold rolling, holding the cold-rolled steel sheet for 11 s or more in a temperature range of the Ac3 point or higher, cooling, the cold-rolled steel sheet heated and held, to a temperature range of 540 to 580° C. at an average cooling rate of 3° C./s or more, and further cooling the cold-rolled steel sheet to a temperature range of 410 to 480° C. within 90 s;

hot-dip galvanizing a base steel sheet obtained by cooling the cold-rolled steel sheet;

heating, a hot-dip galvanized steel sheet obtained by hot-dip galvanizing, to a temperature range of 550° C. or lower to perform alloying treatment of the hot-dip galvanizing; and cooling, an hot-dip galvannealed steel sheet obtained by performing alloying treatment of the hot-dip galvanizing, to a temperature range of 230 to 340° C. at an average cooling rate of 5° C./s or more.

According to this configuration, it is possible to manufacture a high-strength hot-dip galvannealed steel sheet having a yield strength of 970 MPa or more, a tensile strength of 1470 MPa or more, and excellent LME cracking resistance.

In the method for manufacturing a high-strength hot-dip galvannealed steel sheet having the above configuration, the hot-dip galvannealed steel sheet cooled may be worked at an elongation rate of 5% or less.

According to this configuration, a high-strength hot-dip galvannealed steel sheet further excellent in yield strength can be manufactured.

Hereinafter, the present invention will be described more specifically with reference to Examples. However, the present invention is not limited by the following examples and can be carried out while including some modifications within a scope conforming to the gist disclosed heretofore and hereinafter, all such modifications being encompassed within the technical scope of the present invention.

EXAMPLES (Manufacturing Method)

Molten steel was cast to manufacture slabs of the chemical compositions (steel type: A, B, C, D, E, F, G, H, I, J) shown in Table 1. In Table 1, the numerical values marked with "<" mean that the values were below the measurement limit. P, S, N, and O are unavoidable impurities as described above, and the values shown in the columns of P, S, N, and O mean amounts unavoidably contained. The balance of the chemical composition shown in Table 1 is iron and unavoidable impurities other than P, S, N, and O.

Table 1 also shows the Ac3 point and the Ms point of each steel type. The Ac3 point was calculated using the above Formula (2), and the Ms point was calculated using the above Formula (3). When the Ac3 point and the Ms point were calculated, the contents of the elements not added and the elements whose measurement values were below the measurement limit were set to 0.

Table 1 also shows the value (in Table 1, described as "CS value") of "2×[Cr]−[Si]" for each steel type. Here, [Cr] and [Si] represent the contents (mass %) of respective elements in the slab. When the CS value is 0.1 or more, the following Formula (1) is satisfied.

$$2 \times [Cr] - [Si] \geq 0.1 \quad (1)$$

TABLE 1

| Steel | | Chemical composition (mass %) balance: iron and unavoidable impurities | | | | | | | | | | |
|---|---|---|---|---|---|---|---|---|---|---|---|---|
| type | Category | C | Si | Mn | P | S | Al | Cr | Ti | B | Mo | N |
| A | Comparative Example | 0.22 | 0.5 | 2.2 | 0.008 | 0.0020 | 0.040 | 0.04 | 0.026 | 0.0027 | <0.01 | 0.0042 |
| B | Example | 0.23 | 0.5 | 2.2 | 0.008 | 0.0016 | 0.040 | 0.62 | 0.026 | 0.0029 | <0.01 | 0.0046 |
| C | Example | 0.27 | 0.5 | 2.2 | 0.008 | 0.0015 | 0.050 | 0.61 | 0.026 | 0.0029 | <0.01 | 0.0035 |
| D | Comparative Example | 0.21 | 1.1 | 2.2 | 0.009 | 0.0023 | 0.040 | 0.04 | 0.026 | 0.0020 | <0.01 | 0.0035 |
| E | Comparative Example | 0.22 | 1.1 | 2.2 | 0.010 | 0.0019 | 0.040 | 0.59 | 0.051 | 0.0021 | <0.01 | 0.0038 |
| F | Example | 0.21 | 0.1 | 2.3 | 0.010 | 0.0010 | 0.038 | 0.26 | 0.026 | 0.0017 | 0.19 | 0.0031 |
| G | Example | 0.22 | 0.1 | 2.3 | 0.011 | 0.0013 | 0.050 | 0.24 | 0.032 | 0.0019 | 0.20 | 0.0054 |
| H | Example | 0.22 | 0.1 | 2.2 | 0.010 | 0.0018 | 0.038 | 0.25 | 0.031 | 0.0017 | 0.10 | 0.0027 |
| I | Example | 0.23 | 0.1 | 2.4 | 0.009 | 0.0010 | 0.046 | 0.25 | 0.030 | 0.0017 | 0.25 | 0.0040 |
| J | Example | 0.24 | 0.1 | 2.2 | 0.010 | 0.0015 | 0.046 | 0.25 | 0.021 | 0.0017 | 0.25 | 0.0046 |

| Steel | Chemical composition (mass %) balance: iron and unavoidable impurities | | | | | | CS | Ac3 point | Ms point |
|---|---|---|---|---|---|---|---|---|---|
| type | O | Ca | Nb | V | Cu | Ni | value | (° C.) | (° C.) |
| A | 0.0019 | <0.0005 | <0.004 | 0.001 | <0.01 | <0.01 | −0.4 | 803 | 385 |
| B | 0.0011 | <0.0005 | <0.004 | 0.001 | <0.01 | <0.01 | 0.7 | 794 | 370 |
| C | 0.0013 | <0.0005 | <0.004 | 0.001 | <0.01 | <0.01 | 0.7 | 790 | 356 |
| D | 0.0015 | <0.0005 | <0.004 | 0.001 | <0.01 | <0.01 | −1.0 | 833 | 389 |
| E | 0.0015 | <0.0005 | <0.004 | 0.001 | <0.01 | <0.01 | 0.1 | 835 | 374 |
| F | 0.0007 | 0.0015 | <0.004 | 0.003 | <0.01 | <0.01 | 0.4 | 788 | 379 |
| G | 0.0010 | 0.0010 | <0.004 | 0.005 | 0.01 | <0.01 | 0.4 | 795 | 376 |
| H | 0.0009 | 0.0006 | <0.004 | <0.001 | <0.01 | <0.01 | 0.4 | 724 | 379 |
| I | 0.0007 | 0.0023 | <0.004 | 0.001 | <0.01 | <0.01 | 0.4 | 721 | 371 |
| J | 0.0009 | 0.0021 | <0.004 | 0.001 | <0.01 | <0.01 | 0.4 | 726 | 374 |

The slabs of the steel types A to F and H to J were heated to a temperature range of 1,250° C., and the slab of the steel type G was heated to a temperature range of 1,265 to 1,275° C., and then hot-rolled to a thickness range of 2.0 to 3.0 mm to obtain hot-rolled steel sheets. The temperature of the hot-rolled steel sheet at the time of completion of the finish rolling was 900° C. in the steel types A to F and H to J, and 920° C. in the steel type G. The average cooling rate of the hot-rolled steel sheet from the completion of finishing roll of the hot rolling to the start of coiling of the hot-rolled steel sheet was set to 10 to 30° C./s. The coiling start temperature of the hot-rolled steel sheet was set to 650° C. for the steel types A to F and 680° C. for the steel types G to J, and coiling of the hot-rolled steel sheet and processing corresponding the coiling were performed.

The obtained hot-rolled steel sheets were pickled, and then surface grinding and cold rolling were performed in combination to obtain cold-rolled steel sheets having a thickness of 1.4 to 1.6 mm. At this time, the cold rolling rate (rolling rate during cold rolling) of all the steel types was within a range of 10 to 60%. The obtained cold-rolled steel sheets of the steel types A to J were subjected to heat treatments Nos. 1 to 14 shown in Table 2 to prepare steel sheets (steel sheets or hot-dip galvannealed steel sheets) of Experiments Nos. 1 to 18. In the heat treatments Nos. 1 to 7, 13, and 14, a lab simulator was used as a heat treatment furnace, and in the heat treatments Nos. 8 to 12, actual equipment was used. In Experiment No. 11, the "time from the Ac3 point to the highest reached temperature" in the soaking step (step (a) shown in FIG. 1) was 10 s, and the "holding time in the temperature range of the Ac3 point or higher" obtained by adding the "time from the start of cooling from the highest reached temperature to the Ac3 point" to the above time was less than 11 s.

TABLE 2

| | | | | (a) | | (b) | | (c) | |
|---|---|---|---|---|---|---|---|---|---|
| | | | | | Time (s) from | | | | |
| Experiment No. | Steel type | Heat treatment No. | Apparatus | Highest reached temperature (° C.) | Ac3 point to highest reached temperature | Average cooling rate (° C./s) | Reached temperature (° C.) | Time (s) | Reached temperature (° C.) |
| 1 | A | 1 | Lab simulator | 950 | 77 | 14 | 540 | 39 | 460 |
| 2 | B | 1 | Lab simulator | 950 | 78 | 14 | 540 | 39 | 460 |
| 3 | C | 2 | Lab simulator | 950 | 84 | 9 | 580 | 26 | 460 |
| 4 | C | 1 | Lab simulator | 950 | 79 | 14 | 540 | 39 | 460 |
| 5 | C | 3 | Lab simulator | 950 | 79 | 19 | 150 | 26 | 460 |
| 6 | D | 4 | Lab simulator | 950 | 76 | 9 | 580 | 26 | 460 |
| 7 | E | 4 | Lab simulator | 950 | 75 | 9 | 580 | 26 | 460 |
| 8 | F | 5 | Lab simulator | 810 | 65 | 9 | 540 | 39 | 460 |
| 9 | F | 6 | Lab simulator | 850 | 72 | 10 | 540 | 39 | 460 |
| 10 | G | 7 | Lab simulator | 930 | 80 | 13 | 540 | 39 | 460 |
| 11 | G | 8 | Actual equipment | 813 | 10 | 22 | 546 | 60 | 429 |
| 12 | G | 9 | Actual equipment | 862 | 51 | 24 | 571 | 60 | 419 |
| 13 | G | 10 | Actual equipment | 807 | 47 | 20 | 554 | 64 | 427 |
| 14 | G | 11 | Actual equipment | 818 | 51 | 21 | 552 | 61 | 430 |
| 15 | G | 12 | Actual equipment | 864 | 48 | 26 | 575 | 57 | 416 |
| 16 | H | 13 | Lab simulator | 860 | 96 | 7 | 560 | 72 | 460 |
| 17 | I | 14 | Lab simulator | 890 | 100 | 7 | 560 | 72 | 460 |
| 18 | J | 14 | Lab simulator | 890 | 97 | 7 | 560 | 72 | 460 |

| | (d) | (e) | | (f) | | |
|---|---|---|---|---|---|---|
| Experiment No. | Highest reached temperature (° C.) | Average cooling rate (° C./s) | Reached temperature (° C.) | Average cooling rate (° C./s) | Reached temperature (° C.) | Temper rolling (%) |
| 1 | 500 | 20 | 280 | 1.1 | 50 | 0 |
| 2 | 500 | 20 | 280 | 1.1 | 50 | 0 |
| 3 | 500 | 20 | 280 | 1.1 | 50 | 0 |
| 4 | 500 | 20 | 280 | 1.1 | 50 | 0 |

TABLE 2-continued

| | | | | | | |
|---|---|---|---|---|---|---|
| 5 | 500 | 20 | 280 | 1.1 | 50 | 0 |
| 6 | 500 | 20 | 280 | 1.1 | 50 | 0 |
| 7 | 500 | 20 | 280 | 1.1 | 50 | 0 |
| 8 | 500 | 20 | 280 | 1.1 | 50 | 0 |
| 9 | 500 | 20 | 280 | 1.1 | 50 | 0 |
| 10 | 500 | 20 | 280 | 1.1 | 50 | 0 |
| 11 | 451 | 18 | 313 | 2.6 | 50 | 0.18 |
| 12 | 465 | 16 | 335 | 2.8 | 50 | 0.07 |
| 13 | 451 | 17 | 312 | 2.4 | 50 | 0.15 |
| 14 | 454 | 16 | 316 | 2.4 | 50 | 0.18 |
| 15 | 463 | 17 | 339 | 3.0 | 50 | 1.18 |
| 16 | 500 | 17 | 300 | 3.7 | 50 | 0 |
| 17 | 500 | 17 | 300 | 3.7 | 50 | 0 |
| 18 | 500 | 17 | 300 | 3.7 | 50 | 0 |

In the heat treatments Nos. 1 to 7, 13, and 14, after the second cooling step (step (c) shown in FIG. 1), the steel sheets were not subjected to hot-dip galvanizing treatment and alloying treatment. In the heat treatments Nos. 8 to 12, the steel sheets were subjected to hot-dip galvanizing treatment and alloying treatment (step (d) shown in FIG. 1) after the second cooling step.

The steel sheets subjected to the heat treatments Nos. 1 to 7, 13, and 14 were subjected to heat treatment simulating hot-dip galvanizing treatment and alloying treatment (step (d) shown in FIG. 1), and then observation of the structure and evaluation of mechanical properties were performed. The steel sheets subjected to the heat treatments Nos. 8 to 12 were subjected to galvanizing treatment or designated work hardening treatment (temper rolling), and then observation of the structure and evaluation of mechanical properties were performed.

The reason why the steel sheets subjected to the heat treatments Nos. 1 to 7, 13, and 14 were subjected to observation of the structure and evaluation of mechanical properties after the heat treatment simulating hot-dip galvanizing treatment and alloying treatment is that the strength of the steel sheet is not greatly influenced by the presence or absence of galvanizing, whereas the strength of the steel sheet is greatly influenced by the heat treatment.

(Observation of Structure and Evaluation of Mechanical Properties)

For each of the steel sheets of Experiments Nos. 1 to 18 thus obtained, the volume ratio of each structure of martensite, bainite, and retained austenite, the number of laths at a total length of 300 μm, the number being measured by the intercept method, and mechanical properties (0.2% proof stress $\sigma_{0.2}$ and tensile strength TS) were measured according to the following procedure.

(Volume Ratio of Each Structure)

According to the manufacturing method of the present example, the possibility that structures other than martensite, bainite, and retained austenite (for example, ferrite and pearlite) are present in each steel sheet is extremely low. Therefore, structures other than martensite, bainite, and retained austenite were not measured. Hereinafter, the method for measuring the volume ratio of each structure will be described in the order of retained austenite, bainite, and martensite.

(Volume Ratio of Retained Austenite)

The volume ratio of retained austenite was measured as follows. A test piece was cut out into a size of 20 mm×20 mm from a steel sheet after heat treatment (thickness: 1.4 to 1.6 mm). This test piece was ground from the surface to ¼ of the thickness, and the ground surface was polished by chemical polishing (Experiment No. 8) or electrolytic polishing (Experiments Nos. 16 to 18). The volume ratio of retained austenite on the ground surface after polishing was measured by X-ray diffraction (ISIJ Int. Vol. 33. (1993), No. 7, P. 776). A two-dimensional micro X-ray diffractometer (RINT-RAPID II manufactured by Rigaku Corporation) was used for the measurement. Co was used as a target.

Note that, for some test pieces, the volume ratio of retained austenite was assumed to be 5% or less from the amount of C or Si, or heat treatment conditions in the third cooling condition or the fourth cooling condition. Therefore, for such test pieces, the volume ratio of retained austenite was not measured by X-ray diffraction. For steel sheets for which the volume ratio of retained austenite was not measured (Experiments Nos. 1 to 7 and 9 to 15), the maximum value of 5% of the volume ratio of retained austenite was used as an assumed value.

(Volume Ratios of Bainite and Martensite)

The volume ratios of bainite and martensite were measured and calculated by the following procedure. A test piece was cut out into a size of 20 mm×20 mm from a steel sheet after heat treatment (thickness: 1.4 to 1.6 mm). A cross section parallel to the rolling direction of this test piece was polished, and nital corrosion was applied to the polished surface. A photograph (magnification: 3,000 times) of the structure of ¼ of the thickness of the polished surface subjected to nital corrosion was taken using an FE-SEM. The structure was divided into two sections of bainite and martensite based on the color of grains in the structure photograph and the like, and the area ratios of bainite and martensite were measured by the point counting method. Specifically, orthogonal lattices at intervals of 3 μm (intervals of 9 mm in the photograph) were provided on the taken FE-SEM image, and the structure at a point where the lattices intersect at a right angle (lattice point) was divided into bainite and martensite. The structure division was performed at 100 lattice points, and the area ratios of bainite and martensite were calculated using the results. The measurement was performed for one field (one photograph) in each test piece.

Figure 2:
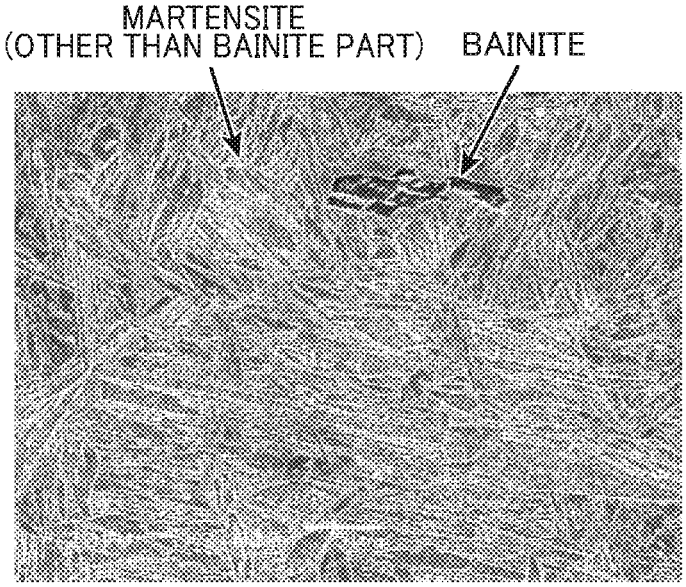
FIG. 2 is an example of a scanning electron micrograph of a cross section of a test piece.

FIG. 2 is an example of a scanning electron micrograph at a magnification of 3,000 times of the structure of ¼ of the thickness of a polished surface subjected to nital corrosion in a cross section parallel to the rolling direction of a test piece. In FIG. 2, the structure appearing black is bainite, and the remaining part is martensite.

As can be seen from the above description, in the present example, the volume ratio of retained austenite and the area ratios of bainite and martensite are measured by different methods, and thus the total of the proportions of the respective structures is not necessarily 100%.

Therefore, in the present example, in determining the volume ratios of bainite and martensite, adjustment was made so that the total of the volume ratios of retained austenite, bainite, and martensite was 100 vol %. Specifically, a numerical value obtained by subtracting the volume ratio of retained austenite (or an assumed value of the volume ratio of retained austenite) measured by X-ray diffraction from 100 vol % was obtained, and this numerical value was regarded as the total volume ratio of bainite and martensite. The total volume ratio of bainite and martensite was proportionally distributed based on the area ratio of each of bainite and martensite, the area ratio being measured by the point counting method, and the obtained value was each taken as the volume ratio of bainite and martensite. The volume ratios of respective structures thus obtained are shown in Table 3.

TABLE 3

| Experiment No. | Steel type | Heat treatment No. | Volume ratio (vol %) in metallographic structure: Retained austenite | Bainite | Martensite | Number of laths at total length of 300 μm | 0.2% proof stress $\sigma_{0.2}$ (MPa) | Tensile strength TS (MPa) | Category |
|---|---|---|---|---|---|---|---|---|---|
| 1 | A | 1 | 5 | 21 | 74 | 261 | 874 | 1366 | Comparative Example |
| 2 | B | 1 | 5 | 0 | 95 | 361 | 1041 | 1560 | Example |
| 3 | C | 2 | 5 | 3 | 92 | 368 | 1118 | 1720 | Example |
| 4 | C | 1 | 5 | 0 | 95 | 287 | 1142 | 1724 | Example |
| 5 | C | 3 | 5 | 0 | 95 | 142 | 1012 | 1235 | Comparative Example |
| 6 | D | 4 | 5 | 14 | 81 | 285 | 900 | 1442 | Comparative Example |
| 7 | E | 4 | 5 | 5 | 90 | 246 | 1043 | 1622 | Comparative Example |
| 8 | F | 5 | 4 | 12 | 84 | 285 | 1054 | 1544 | Example |
| 9 | F | 6 | 5 | 2 | 93 | 255 | 1046 | 1531 | Example |
| 10 | G | 7 | 5 | 1 | 94 | 249 | 1038 | 1494 | Example |
| 11 | G | 8 | 5 | 31 | 64 | 156 | 955 | 1444 | Comparative Example |
| 12 | G | 9 | 5 | 0 | 95 | 237 | 1034 | 1482 | Example |
| 13 | G | 10 | 5 | 9 | 86 | 250 | 1101 | 1556 | Example |
| 14 | G | 11 | 5 | 0 | 95 | 256 | 1128 | 1540 | Example |
| 15 | G | 12 | 5 | 0 | 95 | 250 | 1116 | 1482 | Example |
| 16 | H | 13 | 3 | 0 | 97 | 225 | 984 | 1492 | Example |
| 17 | I | 14 | 3 | 0 | 97 | 213 | 991 | 1541 | Example |
| 18 | J | 14 | 3 | 4 | 93 | 230 | 1000 | 1513 | Example |

(Number of Laths at Total Length of 300 μm)

The number of laths at a total length of 300 μm was measured by the intercept method. The intercept method is a method for usually measuring the particle size (JIS G0551: 2013). In the present example, the intercept method was applied as a method for measuring the number of laths.

Figure 3:
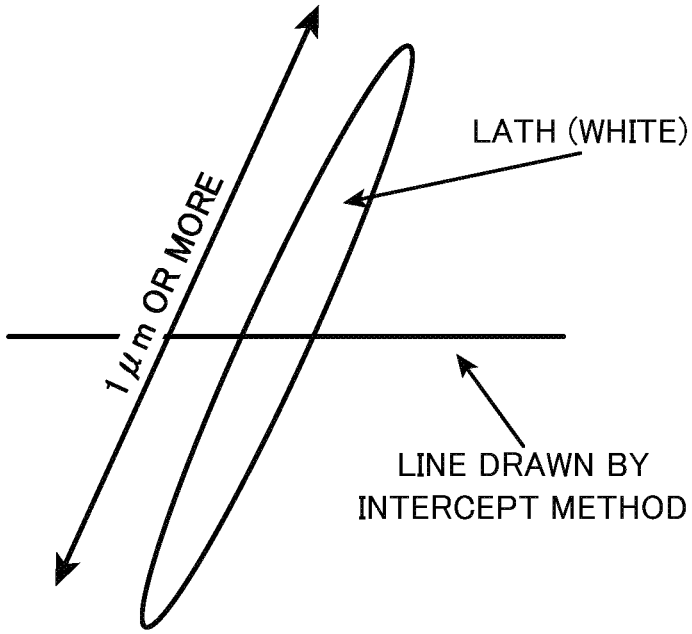
FIG. 3 is a schematic view of a state in which the number of laths is measured by the intercept method.

The number of laths was measured at ¼ of the thickness of a cross section parallel to the rolling direction of the steel sheet. The cross section of the steel sheet was polished, subjected to corrosion using nital, and photographed at a magnification of 3,000 times using FE-SEM. In the taken FE-SEM image, a white region having a longest length of 1 μm or more was defined as the lath. FIG. 3 is a schematic view of a state in which the number of laths is measured by the intercept method. A line (test line) having a total length of 300 μm was drawn on the taken FE-SEM image, and the number of laths through which the line passed (the number of laths intersecting the test line) was measured as shown in FIG. 3. The number of laths intersecting the test line having a total length of 300 μm is referred to as "the number of laths at a total length of 300 μm". The number of laths at a total length of 300 μm measured is shown in Table 3.

(Evaluation of Mechanical Properties)

As the mechanical properties of the heat-treated steel sheet, the tensile strength TS and the 0.2% proof stress $\sigma_{0.2}$ were measured. The tensile strength TS and the 0.2% proof stress $\sigma_{0.2}$ were measured using a JIS No. 5 test piece (plate-like test piece) taken so that a direction perpendicular to the rolling direction of the cold rolling was the longitudinal direction of the test piece. The measurement conditions of Experiments Nos. 11 to 15 are based on JIS Z 2241: 2011. The measurement conditions of Experiments Nos. 1 to 10 and 16 to 18 are based on JIS Z 2241: 2011 except that the crosshead displacement speed was made constant at 10 mm/min. The measured tensile strength TS and 0.2% proof stress $\sigma_{0.2}$ are shown in Table 3. When the tensile strength TS was 1,470 MPa or more and the 0.2% proof stress $\sigma_{0.2}$ was 970 MPa or more, the mechanical properties were regarded as acceptable.

(Evaluation of LME Cracking Resistance)

The LME cracking resistance is greatly influenced by the chemical composition of the steel sheet, and the influence of the heat treatment is smaller than the chemical composition. Therefore, LME cracking resistance can be evaluated by the chemical composition. In the present example, the LME cracking resistance of each steel sheet was evaluated by the following method.

The steel sheets as cold-rolled of the steel types A to F were subjected to electroplating so that the coating weight of galvanizing was 50 g/m$^2$. The obtained galvanized steel sheet was heated to 350° C. to perform alloying treatment of galvanization. The obtained galvannealed steel sheet was each cut, and two samples having a size of 140 mm×35 mm were taken.

Figure 4:
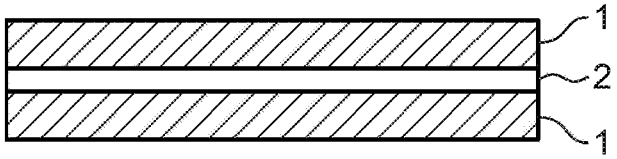
FIG. 4 is a schematic front view of a sample for LME cracking resistance evaluation.

FIG. 4 is a schematic front view of a sample for LME cracking resistance evaluation. As shown in FIG. 4, a soft steel sheet 2 was sandwiched between two taken samples 1 to form a sheet set, and both ends of this three-sheet set were fixed by clamps. Hereinafter, the two samples 1 are also referred to as an upper sheet and a lower sheet, respectively. Resistance spot welding was performed on the center of the fixed three-sheet set to prepare a sample for LME cracking resistance evaluation. As the soft steel sheet 2, a GA steel sheet (hot-dip galvannealed steel sheet) having a tensile strength of 270 MPa, a coating weight of galvanizing on one side of 55 g/m$^2$, and dimensions of 0.75 mm×140 mm×35 mm was used. One sample for LME cracking resistance evaluation was prepared for each of the steel types A to J. The welding conditions were as follows.

Welding machine: AC inverter resistance welding machine
Electrodes: upper and lower DR type Cu—Cr (dome radius type)
Electrode angle: 5°
Electrode diameter: tip diameter 8 mm
Cooling water flow rate: about 2 L/min (upper and lower electrodes)
Electrode force: 350 kgf
Initial electrode force time: 60 cycles/60 Hz
Up slope: 1 cycle/60 Hz
First stage welding
Current value: 7.2 kA
Time (cycles/60 Hz): 8
Second stage welding
Current value: 9 kA
Time (cycles/60 Hz): 17
Down slope (cycles/60 Hz): 30
Hold time (cycle/60 Hz): 5

(LME Cracking Observation Method)

Figure 5:
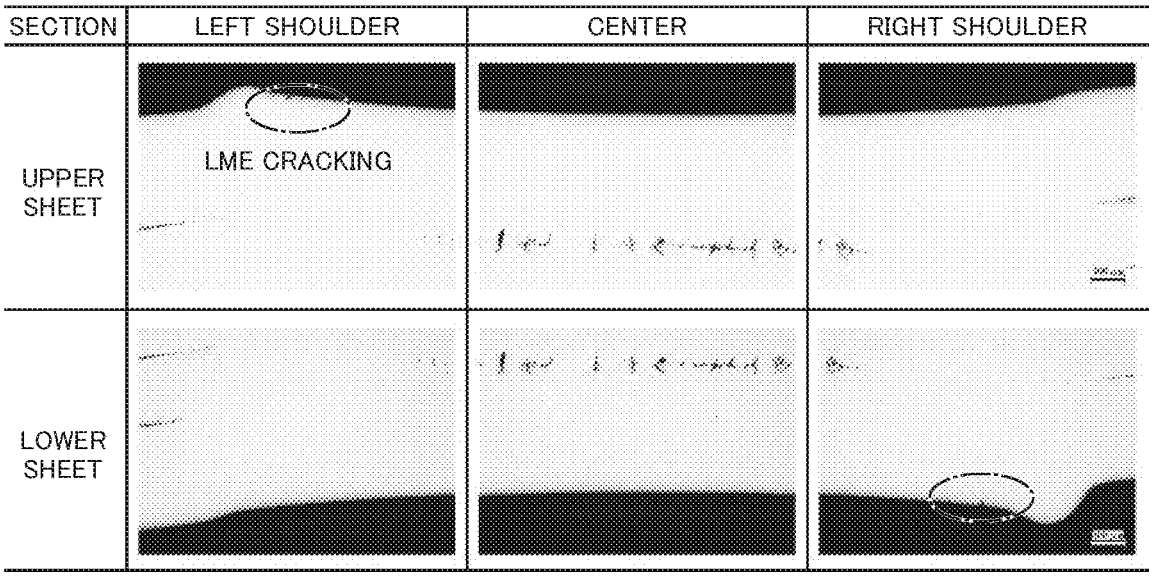
FIG. 5 is an example of an optical micrograph of a sample for LME cracking observation.

A sample for LME cracking observation was prepared from the sample for LME cracking resistance evaluation thus prepared. The sample for LME cracking observation was prepared so that the observation surface was a cross section passing through the diameter of the weld nugget. The surface layer portions of the upper sheet and the lower sheet of the sample for LME cracking observation were observed at a magnification of 25 to 100 times using an optical microscope, and the presence or absence of cracking was examined. FIG. 5 is an example of an optical micrograph of a sample for LME cracking observation. As shown in FIG. 5, a crack having a length of 50 μm or more was determined to be an LME crack in the welded part. As a result of observation of the sample for LME cracking resistance evaluation of each steel type, a sample with cracking was evaluated as x (not acceptable), and a sample without cracking was evaluated as ○ (good), and the evaluation results are shown in Table 4. The evaluation result of the steel type G is estimation.

TABLE 4

| Steel type | Category | Si content (mass %) | Cr content (mass %) | CS value | Evaluation of LME cracking resistance |
|---|---|---|---|---|---|
| A | Comparative Example | 0.5 | 0.04 | −0.4 | X |
| B | Example | 0.5 | 0.62 | 0.7 | ○ |
| C | Example | 0.5 | 0.61 | 0.7 | ○ |
| D | Comparative Example | 1.1 | 0.04 | −1.0 | X |
| E | Comparative Example | 1.1 | 0.59 | 0.1 | X |
| F | Example | 0.1 | 0.26 | 0.4 | ○ |
| G | Example | 0.1 | 0.24 | 0.4 | (○) |
| H | Example | 0.1 | 0.25 | 0.4 | ○ |
| I | Example | 0.1 | 0.25 | 0.4 | ○ |
| J | Example | 0.1 | 0.25 | 0.4 | ○ |

(Evaluation Results)

(Mechanical properties)

From the results shown in Table 2, it can be considered as follows. Experiments Nos. 2 to 4, 8 to 10, and 12 to 18 are examples in which a steel sheet was manufactured under appropriate heat treatment conditions using a steel type satisfying the chemical composition defined in the present invention (steel types B, C, and F to J). In the steel sheets of these examples, the proportion of each structure in the metallographic structure and the number of laths at a total length of 300 μm were appropriately adjusted, the tensile strength TS was 1,470 MPa or more, and the 0.2% proof stress $\sigma_{0.2}$ was 970 MPa or more, and the mechanical properties satisfied the acceptance criteria.

On the other hand, Experiments Nos. 1, 5, 6, and 11 are comparative examples that do not satisfy any of the requirements defined in the present invention. The steel sheets of these comparative examples did not satisfy the acceptance criteria for mechanical properties.

Experiments Nos. 5 and 11 are examples in which the number of laths at a total length of 300 μm defined in the present invention was not satisfied.

In the steel sheet of Experiment No. 5, the reached temperature in the first cooling step (b) was as low as 150° C., and the metallographic structure thereof satisfied the definition of the present invention, but the number of laths at a total length of 300 μm defined in the present invention was not satisfied. Therefore, the tensile strength TS was low, and the mechanical properties did not satisfy the acceptance criteria.

In the steel sheet of Experiment No. 11, the holding time in the temperature range of the Ac3 point or higher in the soaking step (a) was less than 11 s, the number of laths at a total length of 300 μm was smaller than that defined in the present invention, and the volume ratio of bainite and the like was higher than that defined in the present invention. Therefore, the tensile strength TS and the 0.2% proof stress $\sigma_{0.2}$ were low, and the acceptance criteria for the mechanical properties was not satisfied.

Experiments Nos. 1 and 6 are examples using steel types (steel types A and D in Table 1) that do not satisfy the chemical composition defined in the present invention.

In the steel sheet of Experiment No. 1, the amount of Cr in the steel type A was smaller than the amount defined in the present invention, the CS value was less than 0.1, and Formula (1) was not satisfied. As a result, the hardenability was insufficient, and the volume ratio of bainite and the like was higher than that defined in the present invention. Therefore, the tensile strength TS and the 0.2% proof stress $\sigma_{0.2}$ were low, and the acceptance criteria for the mechanical properties was not satisfied.

In the steel sheet of Experiment No. 6, the amount of Si in the steel type D was larger than the amount defined in the present invention, the CS value was less than 0.1, and Formula (1) was not satisfied. As a result, the hardenability was insufficient, and the volume ratio of bainite and the like was higher than that defined in the present invention. Therefore, the tensile strength TS and the 0.2% proof stress $\sigma_{0.2}$ were low, and the acceptance criteria for the mechanical properties was not satisfied.

The steel sheet of Experiment No. 7 was a comparative example using a steel type (steel type E in Table 1) that did not satisfy the chemical composition defined in the present invention, but satisfied the acceptance criteria for the mechanical properties.

(LME Cracking Resistance)

As shown in Table 4, the steel sheets of the steel types (steel types B, C, and F to J) satisfying the chemical composition defined in the present invention had excellent IME cracking resistance. Therefore, it is considered that the steel sheets of Experiments Nos. 2 to 4, 8 to 10, and 12 to 18 using the steel types B, C, and F to J were also excellent in LME cracking resistance.

On the other hand, the steel sheets of the steel type A having a CS value of less than 0.1 and not satisfying Formula (1), the steel type D having an amount of Si larger than the amount defined in the present invention and not satisfying Formula (1), and the steel type E having an amount of Si larger than the amount defined in the present invention were inferior in IME cracking resistance. Therefore, it is considered that the steel sheets of Experiments Nos. 1, 6, and 7 using the steel types A, D, and E were also inferior in LME cracking resistance.

This application is based on Japanese Patent Application No. 2021-088740 filed on May 26, 2021 and Japanese Patent Application No. 2021-142112 filed on Sep. 1, 2021, the contents of which are incorporated therein.

The present invention has been appropriately and sufficiently described through the embodiments with reference to specific examples and the like in the foregoing to express the present invention, but it should be recognized that a person skilled in the art can easily change and/or improve the above-described embodiments. Therefore, unless a change or improvement made by a person skilled in the art is at a level departing from the scope of rights of the claims described in Claims, the change or improvement is interpreted to be included in the scope of rights of the claims.

INDUSTRIAL APPLICABILITY

The present invention has broad industrial applicability in the technical field related to a high-strength hot-dip galvannealed steel sheet and a method for manufacturing the high-strength hot-dip galvannealed steel sheet.

The invention claimed is:

1. A high-strength hot-dip galvannealed steel sheet, comprising:

a plating layer on a surface of a base steel sheet, wherein the base steel sheet comprises, in mass %, C in a range of 0.19 to 0.30%, Si in a range of more than 0 to 0.1%, Mn in a range of 1.8 to 3.0%, P in a range of more than 0 to 0.020%, S in a range of more than 0 to 0.05%, Al in a range of 0.015 to 0.060%, Cr in a range of 0.05 to 0.8%, Ti in a range of 0.015 to 0.080%, B in a range of 0.0010 to 0.0150%;

Mo in a range of more than 0 to 0.40%,

N in an amount of 0.0100% or less,

O in an amount of 0.0030% or less, and the balance including iron and unavoidable impurities, wherein the base steel sheet satisfies $$2 \times [Cr] - [Si] \geq 0.1,$$

[Cr] being a mass percentage of Cr and [Si] being a mass percentage of Si, wherein the base steel sheet has a metallographic structure in which a volume ratio of martensite, which has both tempered martensite and self-tempered martensite, is 82 vol % or more, wherein the base steel sheet has a metallographic structure in which a volume ratio of ferrite, pearlite and bainite is 13 vol % or less in total, wherein the base steel sheet has a metallographic structure in which a volume ratio of retained austenite is 5 vol % or less, wherein, in an image obtained by observing the metallographic structure of the base steel sheet with a scanning electron microscope, a number of laths at a total length of 300 μm, the number being measured by an intercept method is 200 or more, wherein the high-strength hot-dip galvannealed steel sheet has a yield strength of 970 MPa or more, and wherein the high-strength hot-dip galvannealed steel sheet has a tensile strength of 1,470 MPa or more.

2. The high-strength hot-dip galvannealed steel sheet of claim 1, wherein the base steel sheet further comprises, in mass %, Ca in a range of more than 0 to 0.0040%.

3. The high-strength hot-dip galvannealed steel sheet of claim 1, wherein the base steel sheet further comprises, in mass %, Nb in a range of more than 0 to 0.020%, V in a range of more than 0 to 0.30%, Cu in a range of more than 0 to 0.30%, Ni in a range of more than 0 to 0.30%, Mg in a range of more than 0 to 0.0100%, and/or REM in a range of more than 0 to 0.010%.

4. A method for manufacturing the high-strength hot-dip galvannealed steel sheet of claim 1, the method comprising:

hot-rolling a slab having a composition of the base steel sheet, to obtain a hot-rolled sheet;

coiling, at 620° C. or higher, the hot-rolled steel sheet, to obtain a coiled sheet;

uncoiling the coiled sheet, to obtain an uncoiled sheet, and cold-rolling the uncoiled sheet, to obtain a cold-rolled steel sheet;

heating the cold-rolled steel sheet, holding the cold-rolled steel sheet for 11 s or more in a temperature range of the Ac3 point or higher, to obtain a heated sheet, and cooling, the heated sheet, to a temperature in a range of 540 to 580° C. at an average cooling rate of 3° C./s or more, and further cooling the heated sheet to a temperature in a range of 410 to 480° C. within 90 s, to obtain a cooled sheet;

hot-dip galvanizing the cooled sheet, to obtain a hot-dip galvanized steel sheet;

heating the hot-dip galvanized steel sheet to a temperature range of 550° C. or lower to perform alloying treatment of the hot-dip galvanizing, to obtain an alloyed sheet; and cooling the alloyed sheet to a temperature in a range of 230 to 340° C. at an average cooling rate of 5° C./s or more.

5. The method of claim 4, further comprising:

working a hot-dip galvannealed steel sheet cooled, obtained from the cooling of the alloyed sheet, at an elongation rate of 5% or less.

6. The high-strength hot-dip galvannealed steel sheet of claim 2, wherein the base steel sheet further comprises, in mass %, Nb in a range of more than 0 to 0.020%, V in a range of more than 0 to 0.30%, Cu in a range of more than 0 to 0.30%, Ni in a range of more than 0 to 0.30%, Mg in a range of more than 0 to 0.0100%, and/or REM in a range of more than 0 to 0.010%.

7. The high-strength hot-dip galvannealed steel sheet of claim 1, wherein the base steel sheet further comprises Nb in a range of more than 0 to 0.020 mass %.

8. The high-strength hot-dip galvannealed steel sheet of claim 1, wherein the base steel sheet further comprises V in a range of more than 0 to 0.30 mass %.

9. The high-strength hot-dip galvannealed steel sheet of claim 1, wherein the base steel sheet further comprises Cu in a range of more than 0 to 0.30 mass %.

10. The high-strength hot-dip galvannealed steel sheet of claim 1, wherein the base steel sheet further comprises Ni in a range of more than 0 to 0.30 mass %.

11. The high-strength hot-dip galvannealed steel sheet of claim 1, wherein the base steel sheet further comprises Mg in a range of more than 0 to 0.0100 mass %.

12. The high-strength hot-dip galvannealed steel sheet of claim 1, wherein the base steel sheet further comprises REM in a range of more than 0 to 0.010 mass %.

13. The high-strength hot-dip galvannealed steel sheet of claim 2, wherein the base steel sheet further comprises Nb in a range of more than 0 to 0.020 mass %.

14. The high-strength hot-dip galvannealed steel sheet of claim 2, wherein the base steel sheet further comprises V in a range of more than 0 to 0.30 mass %.

15. The high-strength hot-dip galvannealed steel sheet of claim 2, wherein the base steel sheet further comprises Cu in a range of more than 0 to 0.30 mass %.

16. The high-strength hot-dip galvannealed steel sheet of claim 2, wherein the base steel sheet further comprises Ni in a range of more than 0 to 0.30 mass %.

17. The high-strength hot-dip galvannealed steel sheet of claim 2, wherein the base steel sheet further comprises Mg in a range of more than 0 to 0.0100 mass %.

18. The high-strength hot-dip galvannealed steel sheet of claim 2, wherein the base steel sheet further comprises REM in a range of more than 0 to 0.010 mass %.

19. The high-strength hot-dip galvannealed steel sheet of claim 1, wherein the base steel sheet consists of, in mass %:

C in a range of 0.19 to 0.30%;

Si in a range of more than 0 to 0.1%;

Mn in a range of 1.8 to 3.0%;

P in a range of more than 0 to 0.020%;

S in a range of more than 0 to 0.05%;

Al in a range of 0.015 to 0.060%;

Cr in a range of 0.05 to 0.8%;

Ti in a range of 0.015 to 0.080%;

B in a range of 0.0010 to 0.0150%;

Mo in a range of more than 0 to 0.40%;

N in an amount of 0.0100% or less;

O in an amount of 0.0030% or less;

the balance including iron and unavoidable impurities;

optionally, Ca in a range of more than 0 to 0.0040%;

optionally, Nb in a range of more than 0 to 0.020%;

optionally, V in a range of more than 0 to 0.30%;

optionally, Cu in a range of more than 0 to 0.30%;

optionally, Ni in a range of more than 0 to 0.30%;

optionally, Mg in a range of more than 0 to 0.0100%; and optionally, REM in a range of more than 0 to 0.010%.

20. The high-strength hot-dip galvannealed steel sheet of claim 1, wherein the volume ratio of the retained austenite in the base steel sheet is less than 3 vol. %.

* * * * *